US005282116A

United States Patent [19]

Shiau

[11] Patent Number: 5,282,116

[45] Date of Patent: Jan. 25, 1994

[54] FLASHLIGHT

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 16,514

[22] Filed: Feb. 10, 1993

[51] Int. Cl.[5] ..... F21L 7/00

[52] U.S. Cl. ..... 362/205; 200/60

[58] Field of Search ..... 362/158, 205, 204; 200/60

[56] References Cited

U.S. PATENT DOCUMENTS

| | | | |
|---|---|---|---|
| 4,286,311 | 8/1981 | Maglica | 362/205 |
| 4,843,526 | 6/1989 | Price, III | 362/205 X |
| 4,951,183 | 8/1990 | Wang | 362/205 X |
| 5,226,722 | 7/1993 | Maglica | 362/205 X |

*Primary Examiner*—Stephen F. Husar
*Attorney, Agent, or Firm*—Baker & Botts

[57] ABSTRACT

A flashlight includes a barrel, a lamp socket assembly disposed inside the barrel, and a conductive coupling unit disposed inside the barrel around a lamp holder of the lamp socket assembly to connect electrically the barrel and the lamp holder. The coupling unit includes first and second coupling pieces. The first coupling piece is annular in shape and is interposed between and is in tight contact with the lamp holder and the barrel. The first coupling piece has a resilient end portion which is formed from a plurality of frontwardly extending and angularly spaced first peripheral flanges. The second coupling piece has an annular base with a diameter which expands gradually from a rear end to a front end of the annular base. The rear end of the annular base is formed with a plurality of angularly spaced and frontwardly extending second peripheral flanges that contact tightly the lamp holder. The front end of the annular base is formed with a plurality of angularly spaced and frontwardly extending peripheral claws. Each of the peripheral claws inclines slightly in a radial outward direction and extends between two adjacent ones of the first peripheral flanges to contact tightly the barrel.

4 Claims, 4 Drawing Sheets

FLASHLIGHT

BACKGROUND OF THE INVENTION

1. Field of the Invention

The invention relates to a flashlight, more particularly to an improved flashlight construction which is easier to assemble than the prior art.

2. Description of the Related Art

FIG. 1 is an exploded perspective view of a waterproof switching device disclosed in U.S. Pat. No. 4,940,860 by the applicant. FIG. 2 is a fragmentary sectional view of the waterproof switching device when incorporated in a flashlight. The conventional switching device is shown to comprise a switch assembly (10), a lamp socket assembly (15) and a coupling unit (17). The switch assembly (10) includes a generally cylindrical shaped body (11), an electrical switching element (12) and a switchplate (13). The body (11) has a first part (111) in the shape of a segmented cylinder and a second part (112) in the shape of a complementary segmented cylinder. The first and second parts (111, 112) have abutting surfaces which comprise sloping planes that incline longitudinally relative to an axis of the body (11) and that have a conforming sloping relationship so that the first and second parts (111, 112) sealingly engage each other. One end of the body (11) is provided with a blind bore which has an internally threaded surface (113). The lamp socket assembly (15) includes a conductive compression spring (151) which extends into an insulating envelope (152), and a conductive tubular lamp holder (153). The insulating envelope (152) extends into the rear end of the lamp holder (153). The rear end of the lamp holder (153) is formed with an external screw thread (1531) which engages the internally threaded surface (113) of the body (11). The front end of the lamp holder (153) is formed with an internal screw thread (1532) which engages the base of a lamp (154) so as to retain the lamp (154) thereat. The coupling unit (17) is a ring which has an outer peripheral surface that is formed with a screw thread (171). The screw thread (171) engages a corresponding screw thread formed on an inner wall surface of a barrel (18) of a flashlight. The coupling unit (17) is disposed inside the barrel (18) around the lamp holder (153) to connect electrically the barrel (18) and the lamp holder (153). The flashlight is further provided with a head assembly (19) which is mounted rotatably on a front end of the barrel (18). The lamp (154) extends into the head assembly (19). The head assembly (19) is controllably translatable along the barrel (18) when rotated with respect to the barrel (18) in order to achieve a variable focusing effect.

It should be noted that in the conventional flashlight, the switch assembly (10), the lamp socket assembly (15), the coupling unit (17) and the barrel (18) are connected by means of internal and external screw threads. The screw threads should be perfectly matched in order to ensure proper positioning of the lamp (154) and the lamp socket assembly (15) and to further ensure ease of adjustment of the head assembly (19) when varying the focusing of the flashlight. Improperly matched screw threads can seriously affect the quality of the flashlight. Furthermore, since the various components of the flashlight are assembled manually, improper engagement among the screw threads of these components usually occurs, thus necessitating the disassembly of the improperly assembled components and the repetition of the assembly procedure. This results in a waste of time and manpower.

SUMMARY OF THE INVENTION

Therefore, the objective of the present invention is to provide an improved flashlight construction which is easy to assemble and which can overcome the drawbacks that are commonly associated with the aforementioned prior art.

Accordingly, the preferred embodiment of a flashlight of the present invention comprises:

a barrel for housing a battery therein, said barrel being formed with a radial opening adjacent to a front end thereof;

a switch assembly having a generally cylindrical shaped body fitted in the barrel adjacent to the radial opening, and a switching element disposed within the body and connected electrically to the battery, said switching element having a button, said switch assembly further having a switchplate interposed between the barrel and the body, said switchplate covering the button and having an intermediate portion extending out of the radial opening to permit operation of the button;

a lamp socket assembly disposed in the barrel, said lamp socket assembly including a conductive tubular lamp holder which retains a lamp at a front end thereof and which is mounted on one end of the body at a rear end thereof, a tubular insulating envelope extending into the rear end of the lamp holder, and a conductive compression spring extending into the insulating envelope and connecting electrically the switching element and the lamp; and a conductive coupling unit disposed inside the barrel around the lamp holder to connect electrically the barrel and the lamp holder, said coupling unit including first and second coupling pieces, said first coupling piece being annular in shape and being interposed between and being in tight contact with the lamp holder and the barrel, said first coupling piece having a resilient end portion which is formed from a plurality of frontwardly extending and angularly spaced first peripheral flanges, said second coupling piece having an annular base with a diameter which expands gradually from a rear end to a front end of the annular base, the rear end of the annular base being formed with a plurality of angularly spaced and frontwardly extending second peripheral flanges that contact tightly the lamp holder, the front end of the annular base being formed with a plurality of angularly spaced and frontwardly extending peripheral claws, each of the peripheral claws inclining slightly in a radial outward direction and extending between two adjacent ones of the first peripheral flanges to contact tightly the barrel.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 3:
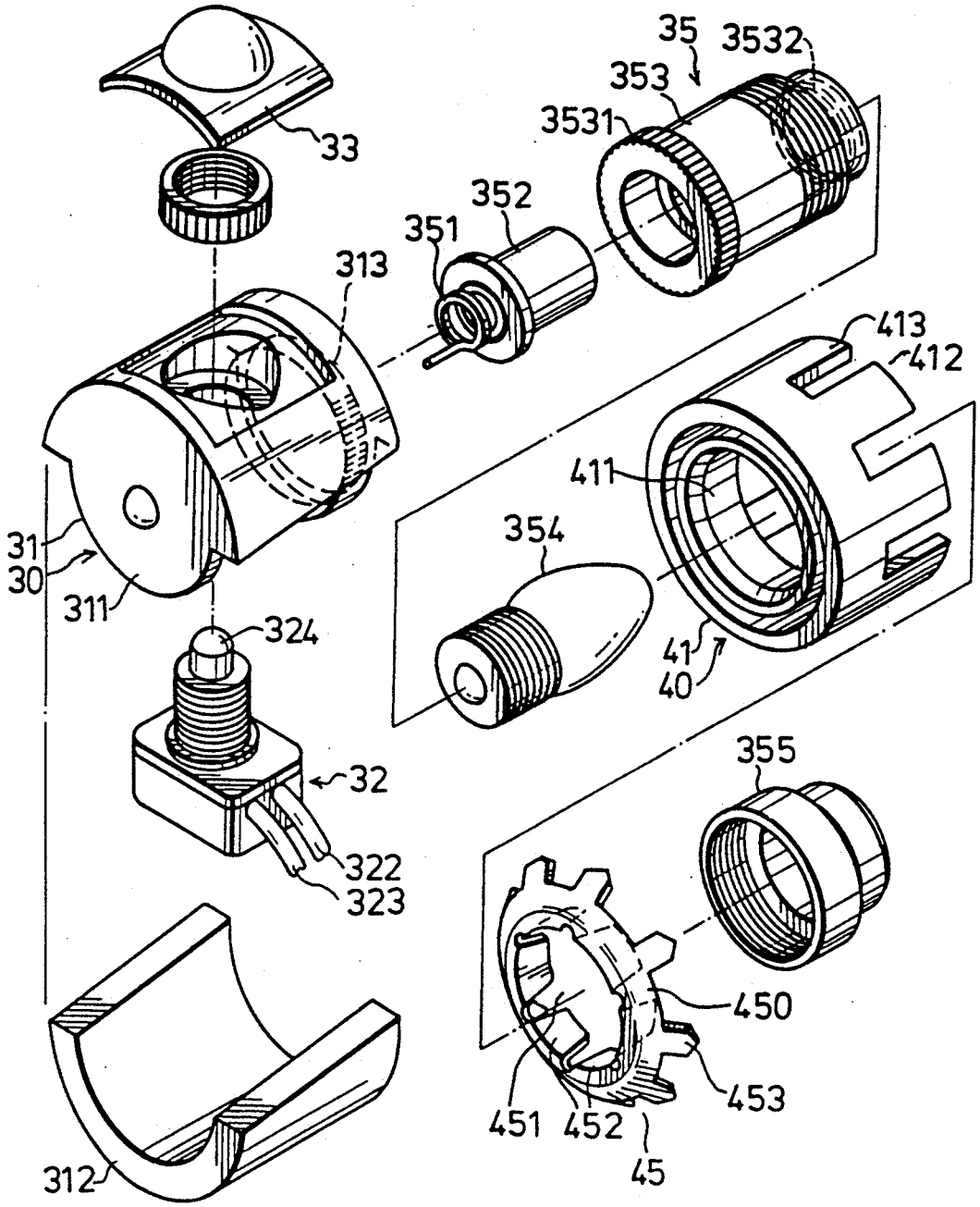
FIG. 3 is an exploded perspective view of a switching device of the flashlight of the present invention.
Figure 4:
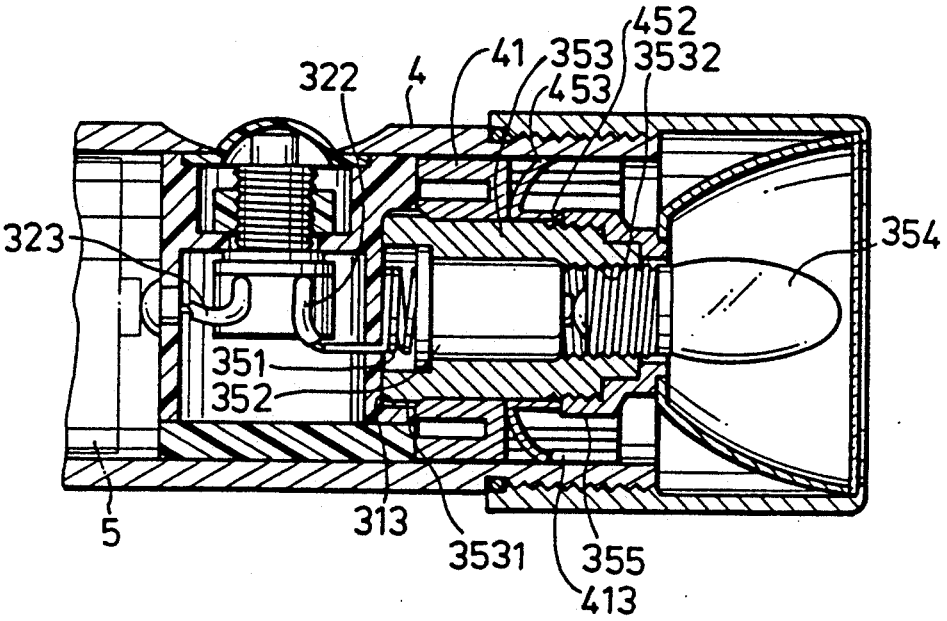
FIG. 4 is a fragmentary sectional view of the preferred embodiment of a flashlight according to the present invention.

Referring to FIGS. 3 and 4, a switching device of the preferred embodiment of a flashlight according to the present invention is shown to similarly comprise a switch assembly (30), a lamp socket assembly (35) and a conductive coupling unit (40).

The switch assembly (30) includes a generally cylindrical shaped body (31), an electrical switching element (32) and a switchplate (33). The body (31) has a first part (311) in the shape of a segmented cylinder and a second part (312) in the shape of a complementary segmented cylinder. The first and second parts (311, 312) have abutting surfaces which comprise sloping planes that incline longitudinally relative to an axis of the body (31) and that have a conforming sloping relationship so that the first and second parts (311, 112) sealingly engage each other. The switching element (32) is disposed within the body (31) and is connected to two connecting wires (322, 323). The switchplate (33) covers a button (324) of the switching element (32).

During assembly, the switching element (32) is secured to the first part (311) and is covered by the switchplate (33). The first part (311) is inserted into the barrel (4) of the flashlight. The second part (312) is then inserted into the barrel (4) such that the second part (312) slides longitudinally with respect to the first part (311) in order to engage sealingly the first and second parts (311, 312) and in order to fit the body (11) in the barrel (4). The periphery of the switchplate (33) is compressed between the first part (311) and the inner wall surface of the barrel (4) to effect a tight seal. An intermediate portion of the switchplate (33), however, extends out of a radial opening formed in the barrel (4) adjacent to a front end of the latter to permit operation of the button (324) of the switching element (32) in order to control operation of the flashlight.

Figure 1:
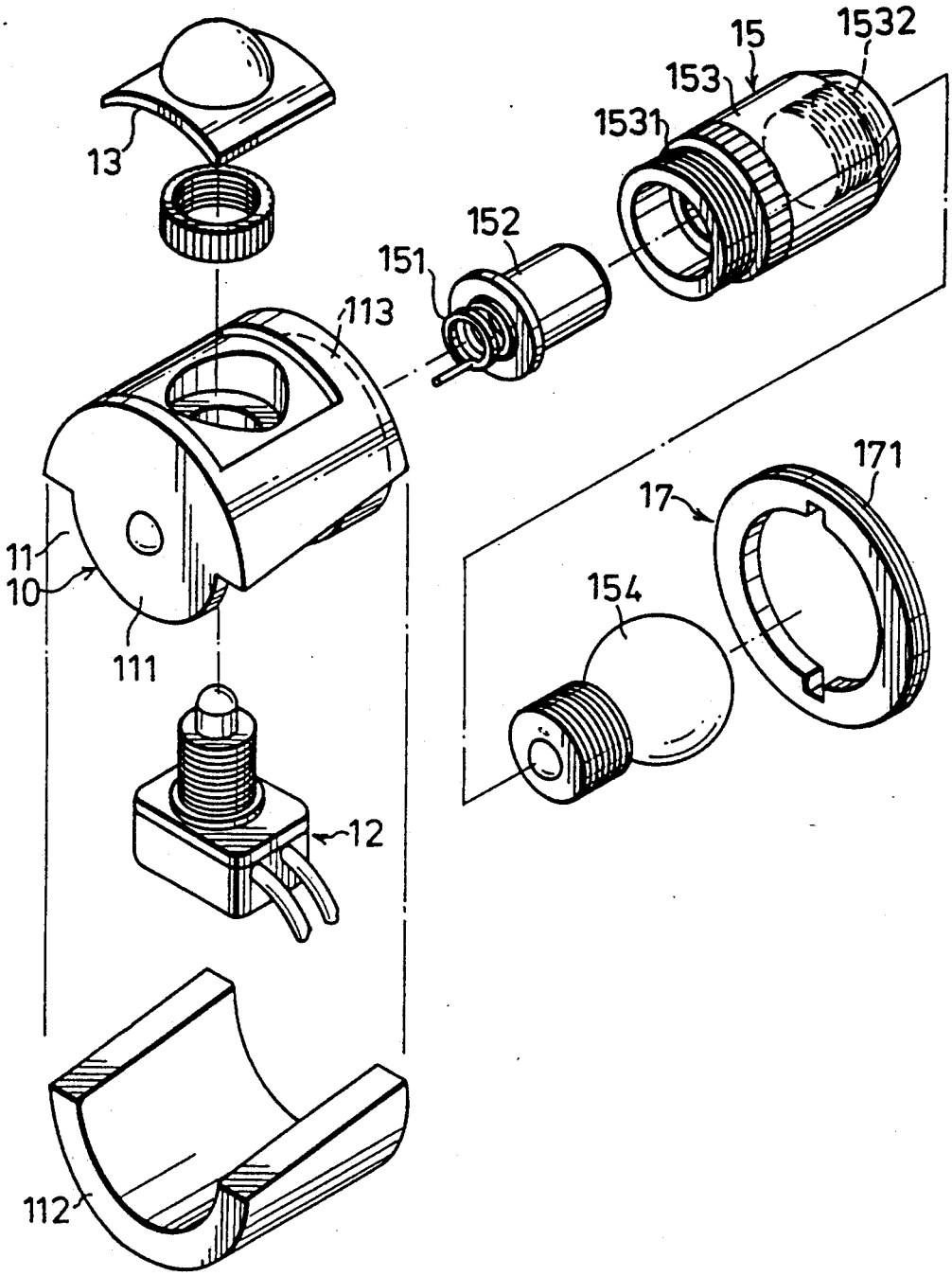
FIG.1 PRIOR ART
FIG. 1 is an exploded perspective view of a conventional waterproof switching device disclosed in U.S. Pat. No. 4,940,860 by the applicant.
Figure 2:
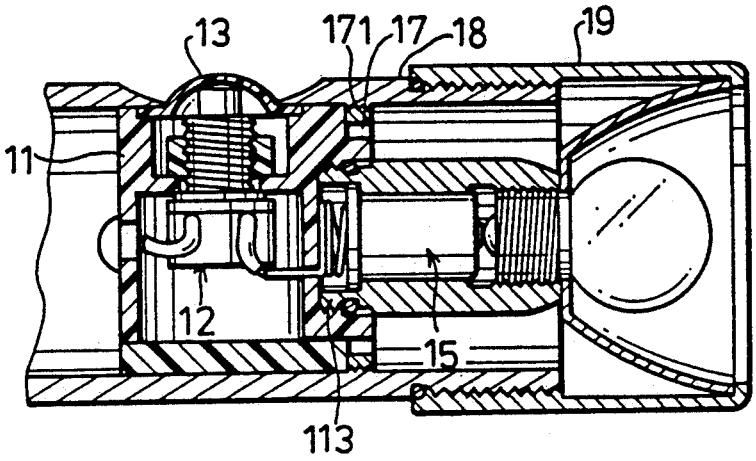
FIG.2 PRIOR ART
FIG. 2 is a fragmentary sectional view of the conventional waterproof switching device when incorporated in a flashlight.

The above described structure is similar to that shown in FIGS. 1 and 2. The characterizing features of the present invention are as follows:

One end of the body (31) is provided with a blind bore which has an internally splined surface (313). The lamp socket assembly (35) includes a conductive compression spring (351) which extends into an insulating envelope (352), and a conductive tubular lamp holder (353). The insulating envelope (352) extends into a rear end of the lamp holder (353). The rear end of the lamp holder (353) is formed with an externally splined surface (3531) which engages tightly and effectively the internally splined surface (313) of the body (31). A front end of the lamp holder (353) is formed with an internal screw thread (3532) which engages the base of a lamp (354) so as to retain the lamp (354) thereat. The lamp (354) has a first terminal, which is in contact with the compression spring (351), and a second terminal which is in contact with the lamp holder (353). A positioning cap (355) is provided with an internally threaded surface and engages threadedly the outer surface of the lamp holder (353) at the front end of the latter. When the lamp socket assembly (35) is mounted on the body (31), the connecting wire (322) is connected to the first terminal of the lamp (354) via the compression spring (351), while the connecting wire (323) is connected to a positive terminal of a battery (5). Operation of the button (324) is conducted to make or break electrical connection between the battery (5) and the lamp (354).

The coupling unit (40) is disposed inside the barrel (4) around the lamp holder (353) to connect electrically the barrel (4) and the lamp holder (353). The coupling unit (40) includes first and second conductive coupling pieces (41, 45). Since the barrel (4) is in contact with a negative terminal of the battery (5), the second terminal of the lamp (354) is connected to the negative terminal of the battery (5) via the barrel (4), the coupling unit (40) and the lamp holder (353).

The first coupling piece (41) is annular in shape and has an outer diameter which is equal to or slightly smaller than the diameter of the barrel (4). The first coupling piece (41) defines a through opening (411) and further has a resilient end portion (412) which is formed from a plurality of frontwardly extending and angularly spaced peripheral flanges (413). The peripheral flanges (413) incline slightly in a radial outward direction. The second coupling piece (45) includes an annular base (450) with a diameter which expands gradually from a rear end to a front end thereof. The rear end of the annular base (450) defines a through opening (451) and is formed with a plurality of angularly spaced and frontwardly extending peripheral flanges (452). The peripheral flanges (452) incline slightly in a radial inward direction. The front end of the annular base (450) is formed with a plurality of angularly spaced and frontwardly extending peripheral claws (453). Each of the peripheral claws (453) inclines slightly in a radial outward direction and extends into the space between two adjacent peripheral flanges (413). The lamp holder (353) extends fittingly into the through openings (411, 451) of the first and second coupling pieces (41, 45). When the coupling unit (40) is inserted into the barrel (4), the peripheral flanges (413) of the first coupling piece (41) and the peripheral claws (453) of the second coupling piece (45) contact tightly the inner wall surface of the barrel (4) At the same time, because of the contraction of the peripheral claws (453) when the coupling unit (40) is inserted into the barrel (4), the peripheral flanges (452) are urged tightly toward the lamp holder (353). Proper positioning of the lamp holder (453) is thus achieved with the use of the coupling unit (40).

It has thus been shown that tight and effective connection among the switch assembly (30), the lamp holder (353), the barrel (4) and the coupling unit (40) can be achieved without the use of internal and external screw threads, as taught in the prior art. The flashlight of the present invention is thus easier to assemble than the prior art. The objective of the present invention is therefore achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A flashlight including a barrel for housing a battery therein, said barrel being formed with a radial opening adjacent to a front end thereof, a switch assembly having a generally cylindrical shaped body fitted in said barrel adjacent to said radial opening, and a switching element disposed within said body and connected electrically to said battery, said switching element having a button, said switch assembly further having a switchplate interposed between said barrel and said body, said switchplate covering said button and having an intermediate portion extending out of said radial opening to permit operation of said button, a lamp socket assembly disposed in said barrel, said lamp socket assembly including a conductive tubular lamp holder which retains a lamp at a front end thereof and which is mounted on one end of said body at a rear end thereof, a tubular insulating envelope extending into said rear end of said lamp holder, and a conductive compression spring extending into said insulating envelope and connecting electrically said switching element and said lamp, and a conductive coupling unit disposed inside said barrel around said lamp holder to connect electrically said barrel and said lamp holder, wherein the improvement comprises:

said coupling unit including first and second coupling pieces, said first coupling piece being annular in shape and being interposed between and being in tight contact with said lamp holder and said barrel, said first coupling piece having a resilient end portion which is formed from a plurality of frontwardly extending and angularly spaced first peripheral flanges, said second coupling piece having an annular base with a diameter which expands gradually from a rear end to a front end of said annular base, said rear end of said annular base being formed with a plurality of angularly spaced and frontwardly extending second peripheral flanges that contact tightly said lamp holder, said front end of said annular base being formed with a plurality of angularly spaced and frontwardly extending peripheral claws, each of said peripheral claws inclining slightly in a radial outward direction and extending between two adjacent ones of said first peripheral flanges to contact tightly said barrel.

2. The flashlight as claimed in claim 1, wherein said first peripheral flanges incline slightly in a radial outward direction.

3. The flashlight as claimed in claim 1, wherein said second peripheral flanges incline slightly in a radial inward direction.

4. The flashlight as claimed in claim 1, wherein:

said one end of said body is provided with a blind bore which has an internally splined surface; and said rear end of said lamp holder is formed with an externally splined surface which engages tightly said internally splined surface of said body.

* * * * *